US005916640A

United States Patent [19]

Liu et al.

[11] Patent Number: 5,916,640

[45] **Date of Patent: *Jun. 29, 1999**

[54] METHOD AND APPARATUS FOR CONTROLLED PARTICLE DEPOSITION ON SURFACES

[75] Inventors: Benjamin Y. H. Liu, North Oaks; James J. Sun, New Brighton, both of Minn.

[73] Assignee: MSP Corporation, Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/706,664

[22] Filed: Sep. 6, 1996

[51] Int. Cl.[6] ..... B05D 1/04

[52] U.S. Cl. ..... 427/475; 427/483; 427/484; 427/444; 239/698; 239/704; 239/707; 239/708

[58] Field of Search ..... 427/444, 475, 427/483, 484; 239/698, 701, 707, 708, 704; 118/626, 638

[56] References Cited

U.S. PATENT DOCUMENTS

| | | | |
|---|---|---|---|
| 2,710,589 | 6/1955 | Brunner | 118/634 |
| 2,742,185 | 4/1956 | Landry | 427/475 |
| 4,073,966 | 2/1978 | Scholes | 427/475 |
| 4,290,384 | 9/1981 | Ausschmitt et al. | 118/722 |
| 4,335,419 | 6/1982 | Hastings | 5/2 |
| 4,356,528 | 10/1982 | Coffee | 361/226 |
| 4,669,671 | 6/1987 | Hastings | 5/2 |
| 4,944,960 | 7/1990 | Sundholm et al. | 427/483 |
| 4,970,093 | 11/1990 | Sievers et al. | 427/38 |
| 5,110,618 | 5/1992 | Faust | 1/4 |
| 5,304,125 | 4/1994 | Leith . | |
| 5,534,309 | 7/1996 | Liu | 427/458 |

FOREIGN PATENT DOCUMENTS

| | | | |
|---|---|---|---|
| 039461 | 11/1981 | European Pat. Off. . | |
| 0 058 571 | 2/1982 | European Pat. Off. . | |
| 0 165 695 | 12/1985 | European Pat. Off. | 1/2 |
| 0 548 926 A1 | 12/1992 | European Pat. Off. . | |
| 0 548 990 A2 | 12/1992 | European Pat. Off. . | |
| 0 608 176 | 7/1994 | European Pat. Off. . | |
| 1 017 481 | 2/1950 | France . | |
| 2 291 800 | 6/1976 | France | 7/32 |
| 2 707 671 | 7/1993 | France . | |
| 525736 | 9/1940 | United Kingdom . | |
| 640808 | 7/1950 | United Kingdom . | |

OTHER PUBLICATIONS

"Aerosol–Assisted Chemical Vapor Deposition of $CeO_2$–Doped$Y_2O_3$–Stabilized $ZrO_2$ Films of Porous Ceramic Supports for Membrane Applications", by Changfeng Xia, Timothy L. Ward and Robert W. Schwartz for *Advanced Materials* Mar. 1996.

"Metalorganic chemical vapor deposition using a single solution source for high $J_c$ $Y_1Ba_2Cu_3O_{7-x}$ superconducting films",by S. Matsuno, F. Uchikawa, and S. Utsonomiya for *Applied Physics Letters*, May 1992.

"Flexible System for Controlled Chemical Delivery of Vapors" for *IBM Technical Disclosure Bulletin*, vol. 33, Aug. 1990.

Chen, Da–Ren and David Y.H. Piu, "Electrospraying of conducting liquids for monodisperse aerosol generation in the 4 nm to 1.8 μm diameter range", J. Aerosol Science, 26:963–977, 1995.

*Primary Examiner*—Shrive Beck
*Assistant Examiner*—Fred J. Parker
*Attorney, Agent, or Firm*—Westman, Champlin & Kelly, P.A.

[57] ABSTRACT

An atomizer has a chamber holding a liquid containing particles of a desired material. Aerosol particles are formed by using an aspirating nozzle or ultrasonic vibrator and the aerosol particles are carried in a gas flow. The aerosol particles are treated by increasing the charge on the aerosol particles by contact with a high voltage electrode and the aerosol particles are passed through inertial separator stages to remove large aerosol particles from the flow so they are not discharged from the atomizer.

17 Claims, 6 Drawing Sheets

METHOD AND APPARATUS FOR CONTROLLED PARTICLE DEPOSITION ON SURFACES

BACKGROUND OF THE INVENTION

The present invention relates to a atomizer that permits forming an aerosol that is rapidly deposited onto a surface, such as a wafer to avoid uneven deposition.

U.S. Pat. No. 5,534,309, discloses a method and apparatus for the controlled deposition of particles on wafer surfaces. In FIG. 3 of that patent an apparatus is shows where electrically charged aerosol particles are introduced into a deposition chamber. An electric field is established above the wafer surface to deposit the charged particles onto the wafer at a rate that is higher than can be achieved without such an electric field. Without an applied electric field, particles can deposit onto the wafer only by the usual mechanisms of gravitational settling and Brownian diffusion. However, these mechanisms are insufficient by themselves to deposit particles at a sufficient high rate onto the wafer for certain applications. To achieve a high deposition rate, it is essential that a source of aerosol particles carrying a high level of electric charge be used, and that the electric field above the wafer be as high as practical to aid in particle deposition.

Although increasing the electric field can increase the rate of deposition, the magnitude of the electric field is limited by electrical break-down in the carrier gas. At atmospheric pressures, if the gas is nitrogen or air, the maximum electric field is limited to 30,000 V/cm in order to avoid sparking or creating a corona discharge. If the applied electric field cannot be increased to a high enough level to achieve an adequate deposition rate, the only recourse is to increase the charge on the particles in order to increase the rate of deposition.

Although aerosol particles produced by atomization usually carry a natural electrical charge, the level of charge is quite low and inadequate for achieving a high deposition rate.

SUMMARY OF THE INVENTION

The present invention provides an aerosol generator for increasing the efficiency of deposition of the aerosol particles by enhancing the rate of deposition of the particles on a surface and reducing waste. Aerosol particles are small solid or liquid particles suspended in a gas. Aerosol particles of a desired material can be created by atomizing a liquid containing the desired material in a solution or suspension form, the liquid being volatile so it can be evaporated from the droplets to form aerosol particles of the desired material. The present invention provides a way of controlling the electrical charge on the particles so created and also controls the size of aerosol particles in order to make the deposition on a wafer more uniform. When the aerosol particles are produced by atomization, it is unavoidable that certain unwanted large droplets are also produced due to splashing of the liquid in the atomizer. If an ultrasonic atomizer or a compressed gas atomizer is used to atomize a liquid to form an aerosol, the aerosol particles are usually distributed over a wide particle size range. The large droplets produced by splashing of liquid may be carried by the airflow into the deposition chamber, and deposit on the wafer to cause non-even deposition patterns. Uneven deposition is undesirable and must be avoided in order to produce wafers of the highest quality.

In addition, large aerosol particles can easily deposit in the tubing carrying the aerosol into the deposition chamber.

Over time, the tubing can become coated with a layer of the material used for forming the particles, which can be re-entrained and carried into the chamber and then deposit on the wafer as an unwanted contaminant.

In this invention, method and apparatus are described which can effectively eliminate such large droplets from the aerosol stream to avoid contaminating the tubing carrying the aerosol to the deposition chamber, and causing wafer contamination and an uneven deposition pattern on the wafer.

In addition to the above, the aerosol particles must be supplied to the deposition device in a controlled manner in order to deposit a precise quantity of particles onto the wafer. The present invention includes means by which aerosol delivery can be controlled so that a precise amount of the aerosol material can be delivered to the deposition chamber and deposited on the wafer surface.

DETAILED DESCRIPTION OF THE PREFERRED EMBODIMENTS

Figure 1:
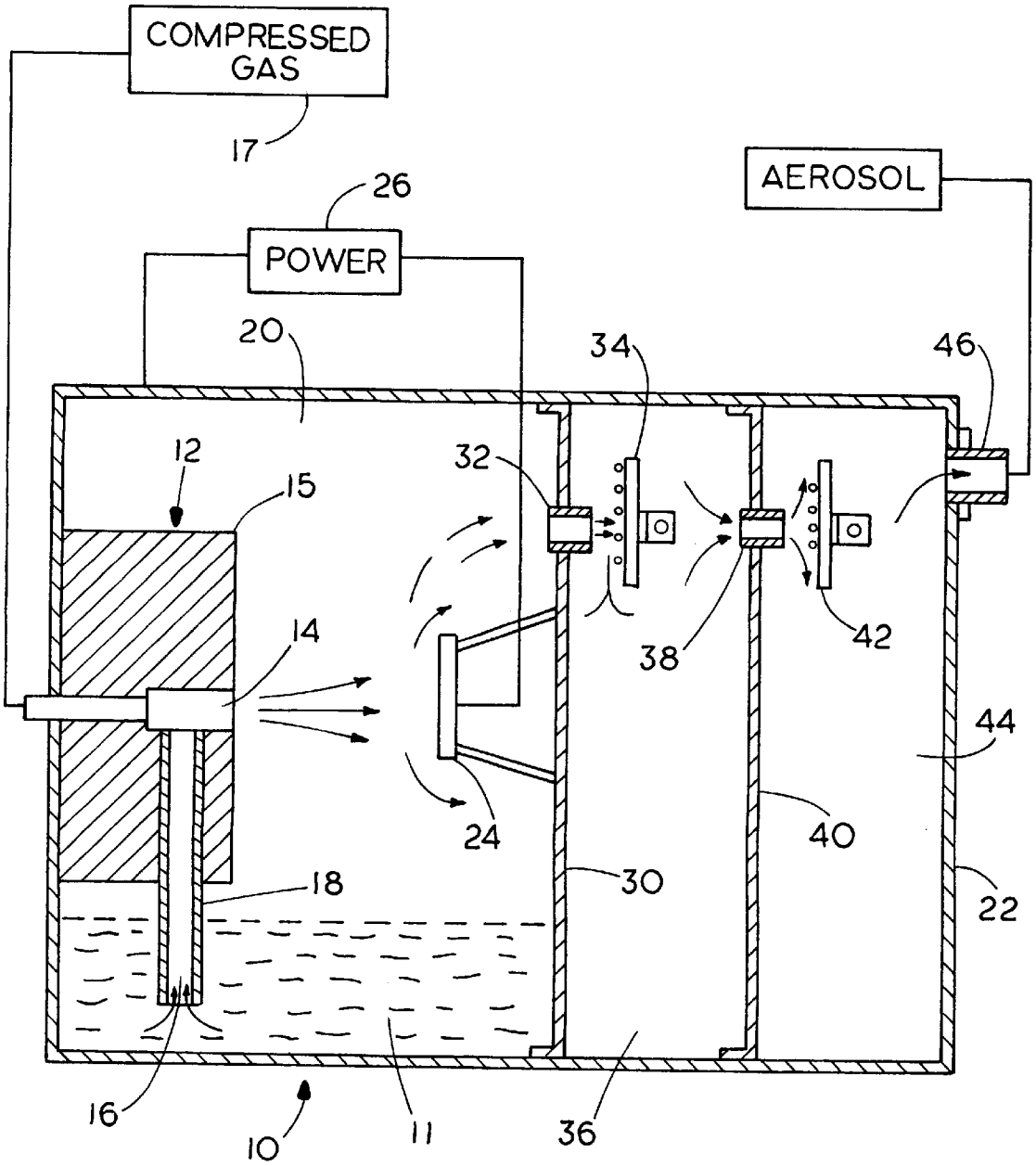
FIG. 1 is a schematic representation of an aerosol generator used for controlled particle deposition according to the present invention.

FIG. 1 is a schematic diagram of an aerosol generation apparatus 10 in which a compressed gas atomizer 12 is used to atomize a liquid 11 to form an aerosol. The atomizer 12 consists of one or more nozzles, with only one nozzle 14 shown, to form a high velocity gas jet. A compressed gas source 17 provides the high velocity gas flow. The liquid to be atomized is aspirated into the nozzle 14 through a tube 18. The liquid 16 entering the nozzle 14 is sheared by the high velocity gas flow to form droplets containing the desired particle material to be deposited that are expelled into a chamber 20 of an outer housing 22.

As mentioned earlier, the droplets formed are usually charged to some extent naturally, as a result of the electrical properties of the liquid 16. To increase the charge on the droplets, an induction electrode 24, is located at a short distance from the nozzle and aligned with the nozzle. A power supply 26 is used to establish a potential difference between the induction electrode and the atomizing nozzle 14. The potential difference created between the induction electrode 24 and the nozzle 14 causes an electric field to be established at the nozzle, leading to the appearance of an electric or electrostatic charge on the droplets at the time they are formed at the nozzle by the gas jet. The level of electrical charge on the droplets created this way can be adjusted by adjusting the potential difference between the electrode and the nozzle 14. FIG. 1 indicates that the housing 22 and the block 15 in which the nozzle 14 is formed are electrically connected and at the same potential.

To eliminate the unwanted large liquid droplets produced by the atomizer, one or more stages of an inertial impactor are provided. As shown, the divider wall 30 has one or more tubes or nozzles 32 through the wall and forms an outlet from the chamber 20. A first impactor plate 34 is supported on the housing and is aligned with the tube or nozzle 32. The impactor plate has a surface perpendicular to the axis of the tube or nozzle 32. The gas stream exiting chamber 20 carries the droplets through the tube or nozzle 32. The high velocity gas passing through the tube or nozzle 32 is directed at a surface to cause droplet impaction on the surface. Droplets larger than the cut-point diameter of the impactor are removed by impaction as a result of the large mass of the droplets, while smaller droplets or aerosol particles, with insufficient mass to impact, are carried by the gas stream through chamber 36 and out a tube or nozzle 38 mounted in a wall 40 forming the back wall of chamber 36. A second impactor plate 42 is aligned with the tube or nozzle 38 and larger droplets are impacted and removed from the flow of gas. The aerosol, carrying only droplets smaller than the cut point of these impactors, is then discharged from the chamber 44 through an outlet 46.

To insure that unwanted large droplets are completely removed, several such inertial impaction stages may be put in series. While two impaction stages are shown, in some critical applications, three, four or more stages may be necessary to insure the complete removal of unwanted large droplets from the gas stream.

The disclosed inertial impactor is one of several such inertial particle collectors that can be used for removing large droplets from the aerosol stream. Other inertial particle collectors that can be used include cyclones and impingers, among others.

Figure 2:
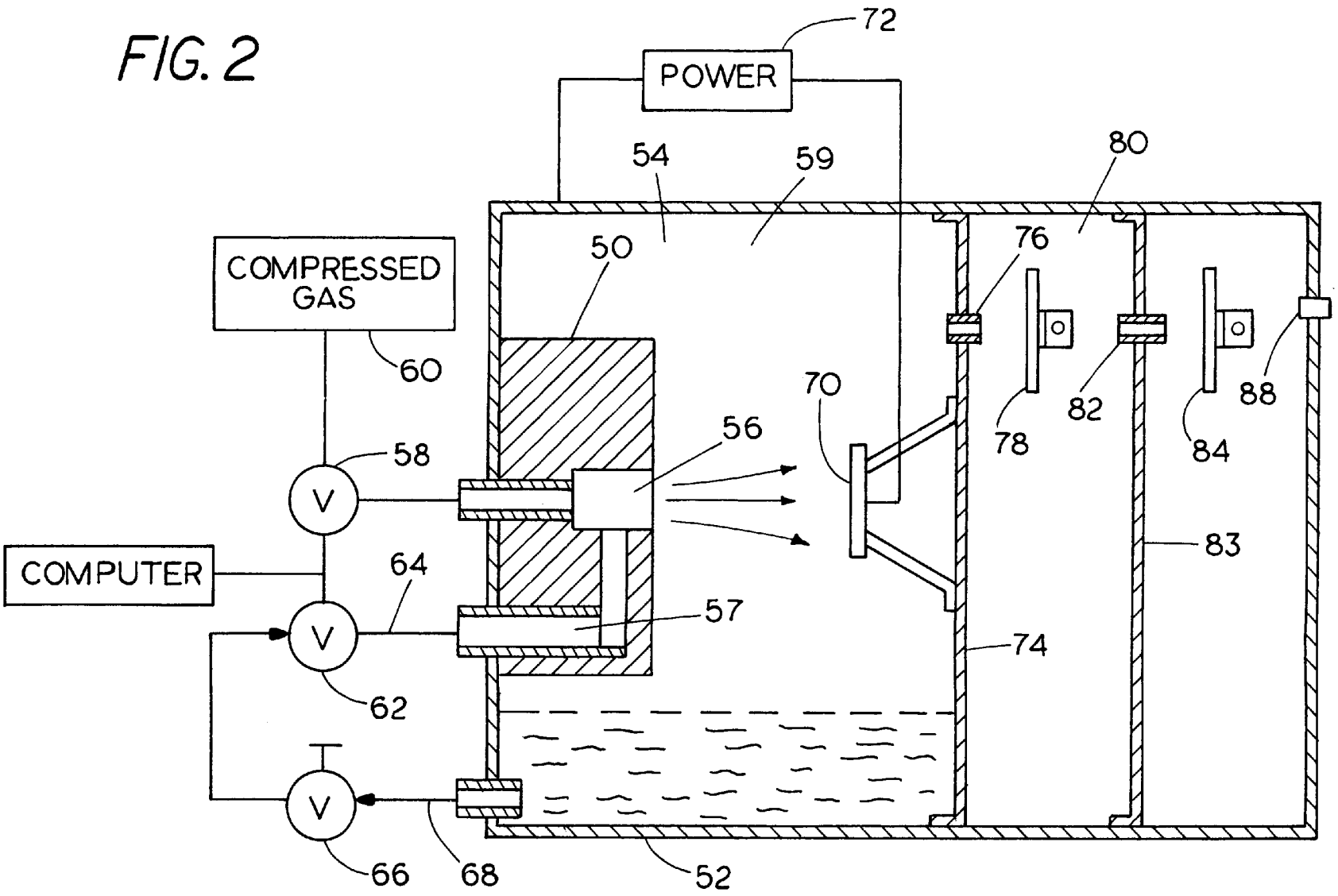
FIG. 2 is a modified form of the present invention providing for control valves to control the input of liquids and gas into the aerosol generator.

To control the precise delivery of aerosols to the deposition chamber or for other applications, the atomizer 50 shown in FIG. 2 has a housing 52 forming a chamber 54 and an aspirating nozzle 56. A control valve 58 controls flow of gas from a source 60 to nozzle 56. A computer 62 controls an electrical or pneumatic control signal to valve 58 and compressed gas, such as compressed air, compressed nitrogen, or argon, etc. is supplied to the atomizer 50 to begin aerosol generation. Upon removal of the control signal to the valve, the compressed gas supply to the nozzle 56 is stopped. Atomization and aerosol generation will then stop.

As an alternative to using control valve 58 in the compressed gas line for controlling atomization, a control valve 62 can be installed in the liquid flow line 64 as shown in FIG. 2. When a control signal is applied to valve 62 it will open to allow liquid flow to the atomizing nozzle 56 through 57 to begin liquid atomization. An additional valve 66 is installed in a liquid line 68 leading to valve 62. Valve 66 is a valve with an adjustable opening, which is adjusted, usually manually, to achieve a desired liquid flow rate to the line 64 and atomizing nozzle 56 for the optimal formation of liquid droplets. For control purposes, although only one of the valves 58 or 62 is needed to control the start and stop of the atomization process, both valves may be used in the same apparatus to provide more flexibility by controlling liquid and gas flows separately.

To increase the charge on the droplets, an induction electrode 70 is located at a short distance from the nozzle and aligned with the nozzle. A power supply 72 is used to establish a potential difference between the induction electrode 70 and the atomizing nozzle 56. The potential difference created between the induction electrode 70 and the nozzle 56 causes an electric field to be established at the nozzle, leading to the appearance of an electric charge on the droplets at the time they are formed at the nozzle by the gas jet. The level of electrical charge on the droplets created this way can be adjusted by adjusting the potential difference between the electrode and the nozzle 56. The electrodes are mounted on an insulating support in the chamber in which they are used.

To eliminate the unwanted large liquid droplets produced by the atomizer, one or more stages of an inertial impactor are provided. As shown, the divider wall 74 has a tube or nozzle 76 through the wall and forms an outlet from the chamber 59. A first impactor plate 78 is supported on the housing and is aligned with the tube or nozzle 76. The impactor plate 78 has a surface perpendicular to the axis of the tube or nozzle 76. The gas stream exiting chamber 59 carries the droplets through the tube or nozzle 76 into a chamber 80. The high velocity gas passing through the tube or nozzle 76 is directed at a surface to cause droplet impaction on the surface. Droplets larger than the cut-point diameter of the impactor are removed by impaction as a result of the large mass of the droplets, while smaller droplets, with insufficient mass to impact, are carried by the gas stream through chamber 80 and out a tube or nozzle 82 mounted in a wall 83 forming the back wall of chamber 80. A second impactor plate 84 is aligned with the tube or nozzle 82 and remaining larger droplets are impacted and removed from the flow of gas. The aerosol, containing droplets smaller than the cut point diameter of these impactors, is then discharged from a chamber 86 through an outlet 88.

Figure 3:
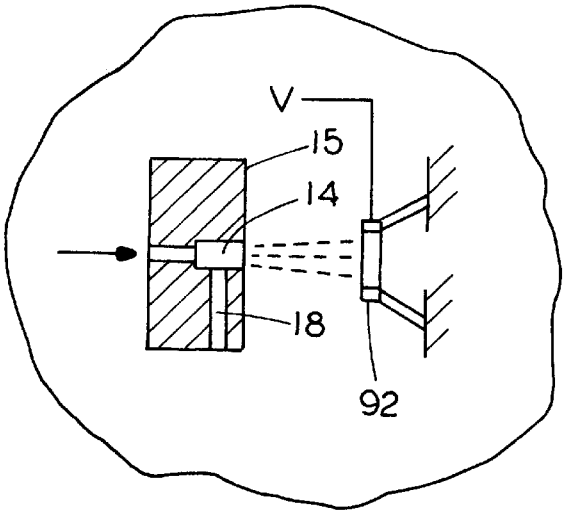
FIG. 3 illustrates a nozzle for forming an aerosol used in connection with a ring type electrode.

The induction electrode used in the apparatus shown in FIG. 1 is in the form of a solid electrode plate located in close proximity to the nozzle. However, various electrode shapes are usable. In FIG. 3 a ring shape electrode 92 is shown spaced from and aligned with the nozzle 14 in the block 15. The passage 18 will aspirate liquid as in the apparatus of FIG. 1. The gas jet and droplets aspirated will pass through the ring electrode and be charged as in the device of FIG. 1. A voltage source from the power supply of FIG. 1 also will be used. The ring electrode can be put into the housing of FIG. 1 and the atomizer will operate as before but with the capabilities of a ring electrode for adding a charge to the droplets and particles.

Figure 4:
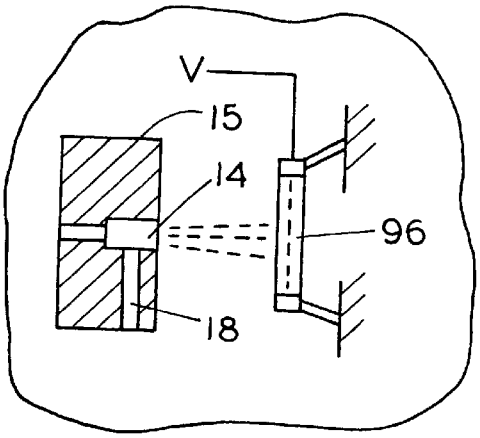
FIG. 4 illustrates a nozzle used with the generator FIG. 1 having a screen type electrode.

In FIG. 4, the electrode 96 is in the form of a mesh screen. This also lets the jet of air and particles pass through the screen and receive a charge from the voltage applied. The screen electrode is merely placed into the housing of FIG. 1 and the atomizer operates as before.

Figure 5:
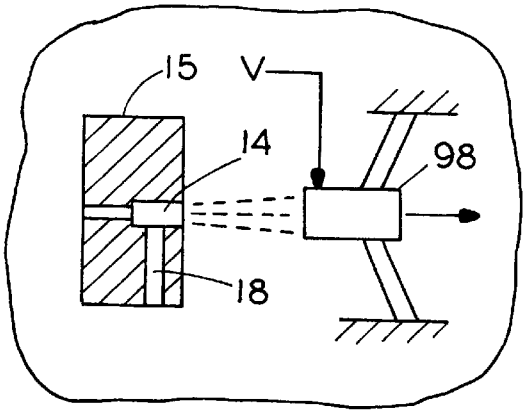
FIG. 5 illustrates the nozzle used with FIG. 1 for generating an aerosol used with a tubular electrode.

The electrode in FIG. 5 is in the form of a straight axis tube 98. Again the jet of gas and droplets and particles aspirated will pass through the tube 98 and the droplets will be charged from the voltage applied from the power supply.

Figure 6:
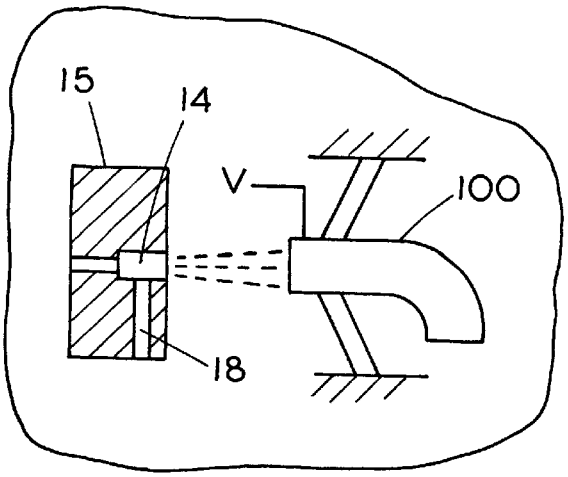
FIG. 6 is a schematic illustration of the nozzle of the device of FIG. 1 illustrating a curved tube electrode for charging the particles.

The electrode shown in FIG. 6 is in the form of a curved tube 100. The droplets are charged as they pass through the tube 100, and will be directed downwardly in the chamber 20 of the atomizer of FIG. 1. The voltage is provided to the tube from the power supply.

Indeed, electrodes of many other geometrical shapes can be used to induce a charge on the droplets containing particles. The requirement is that the induction electrode be insulated and that a sufficiently high voltage can be applied to the induction electrode relative to the atomizing nozzle to establish an electric field at the atomizing nozzle to cause droplet charge generation by induction. The advantage of using a straight tubing shown in FIG. 5, or a curved tubing shown in FIG. 6 is that the large droplets produced by atomization can be captured or collected on the walls of the tube to remove them from the gas stream, while not removing significant amounts of the fine droplets which are to be delivered from the outlet of the atomizer to the deposition chamber for deposition on the wafer.

For some applications when the natural electrical charge is adequate or when particles can be deposited on a wafer without the use of an external electric field, the apparatus of FIGS. 1 and 2 can be used with only the impactor plate or plates to remove large droplets and particles. No induction electrode is used, but the impactor plate or plates alone supply a source of large particle-free aerosol to the deposition chamber and provide the method for the precise control of aerosol delivery to the deposition chamber. The resulting systems are exactly like the systems of FIGS. 1 and 2 except the electrodes are removed from chambers 20 and 59, respectively. An impactor plate is then placed in alignment with the nozzle carrying the droplets and inertial separation will occur in the chambers 20 and 59, respectively.

For applications where a charged aerosol is needed, but it is unnecessary to remove the coarse droplets, the atomizers will be configured with only the chambers 20 and 59 with the electrodes installed. There would be no impactor stages and the aerosol will be used as it is discharged from the chambers 20 or 59.

When the induction electrode is held at a sufficiently high voltage relative to the surface of the liquid at the nozzle, a phenomenon known as electrospray may begin to operate to cause liquid atomization. In electro-spray systems which are known, the liquid is supplied to the nozzle head at a controlled rate. The high voltage electric field at the nozzle surface produced by the induction electrode causes the liquid to spray into a stream of fine droplets without the use of an atomizing gas. The droplets produced by electrospray are usually quite small and are advantageous for certain applications.

Figure 7:
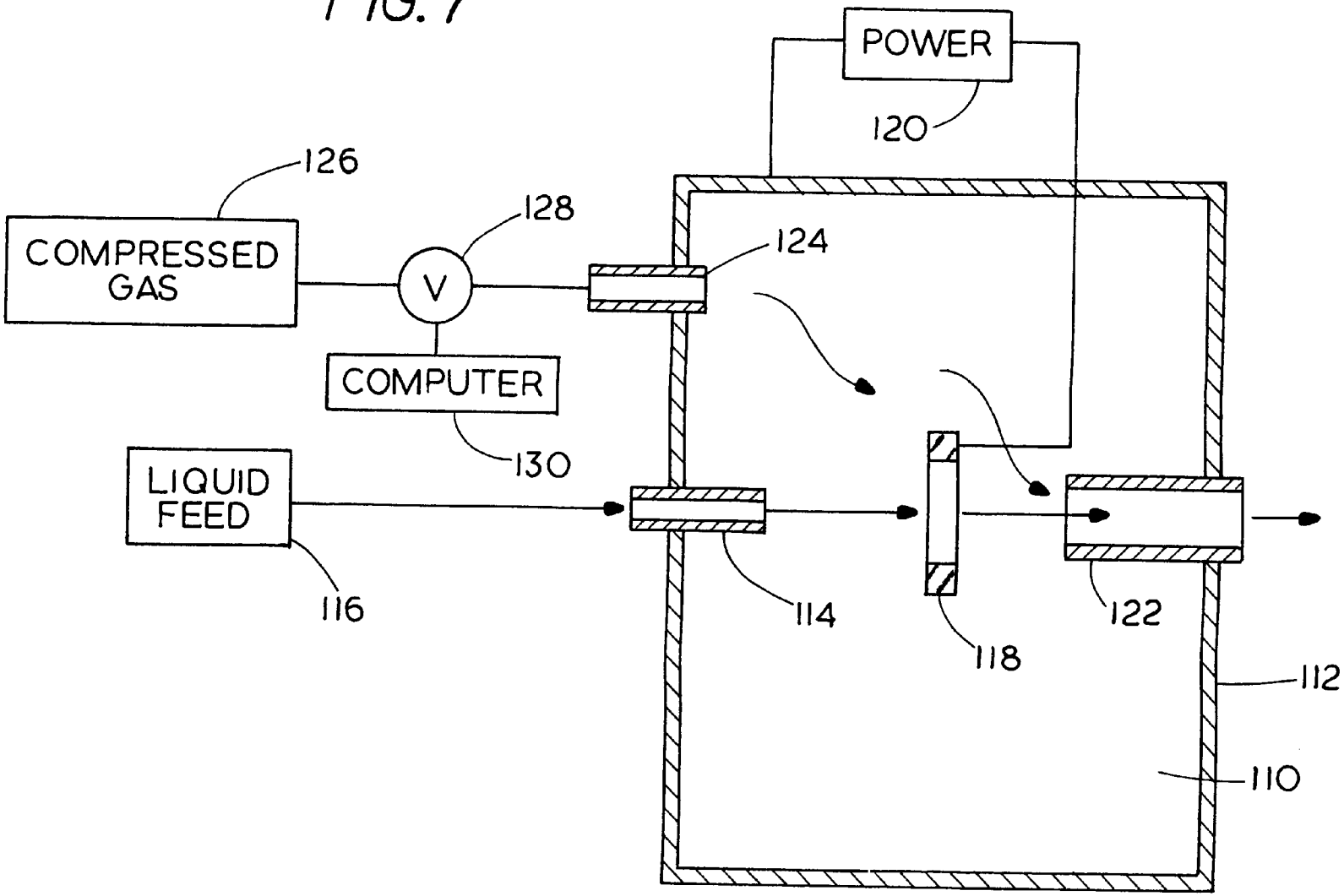
FIG. 7 includes a modified form of the present invention schematically showing the use of impactors for removing large particles from an ultrasonic nebulizer prior to discharging the aerosol.

FIG. 7 shows a system using an electrospray to produce fine droplets for deposition onto a wafer. A chamber 110 is formed by a housing 112, and an inlet tube 114 carries liquid with the desired particle material, into the chamber 110 from a liquid feed 116. The liquid feed is a jet, under sufficient pressure so the spray or jet reaches an electrode 118. The electrode 118 is a ring type electrode, as shown, that has a central axis aligned with the tube 114.

The electrode 118 is insulated from the housing and is connected to a power supply 120. An outlet tube 122 passes through the rear wall of the housing 112 for providing an outlet for the charged particles. The outlet tube is of larger diameter than the inlet tube 114.

Although a compressed gas is unnecessary for atomization in this case, gas is introduced into the spraying chamber through a gas inlet 124 from a compressed gas source 126. The line form the source to the inlet has a valve 128 for controlling gas flow into chamber 110. The valve 128 may be controlled automatically by a computer 130.

The gas flow serves to convey the droplets out of the chamber 110 to form an aerosol for delivery to the desired location for deposition onto a wafer. The use of a computer controlled valve for controlling gas flow into the atomizer chamber makes it possible to control the precise delivery of the charged aerosol to the deposition chamber.

It should be noted that the material and large droplets that are removed by the impactor stages are salvaged and returned to the supply liquid. The discharges aerosol has fine droplets so a high percentage of the particles are utilized on the wafers on which the particles are used.

Figure 8:
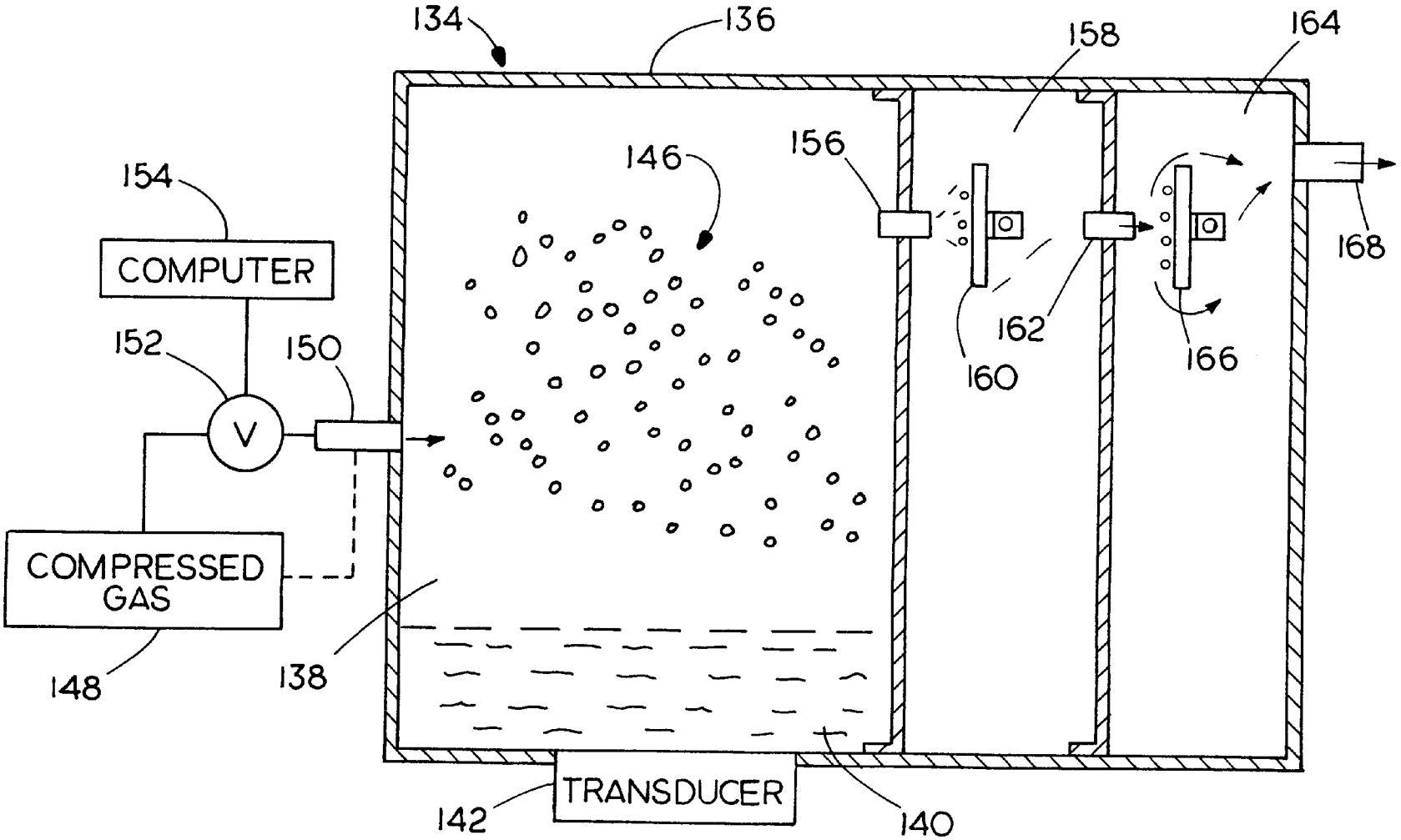
FIG. 8 is a schematic representation of an electrospray generator for producing an aerosol for surface particle deposition.

In some cases, it may be advantageous to use high frequency ultrasonic energy to breakup the liquid to form an aerosol rather than using a compressed gas source to supply energy for atomization. The methods described above for the removal of large droplets and for controlling gas flow to carry the droplets to the deposition chamber can still be used. FIG. 8 shows an ultrasonic nebulizer 134 for liquid atomization.

The nebulizer comprises, in schematic form, a housing 136 having a chamber 138 with a liquid 140 partially filling the chamber. An ultrasonic transducer 142 is in contact with the liquid in the chamber and it is powered to provide ultrasonic energy to the liquid to break up the liquid into droplets 146 above the liquid level. Compressed gas from a source 148 is provided to an inlet tube 150 leading to the chamber 138. The gas can be provided through a valve 152 which is controlled by a computer 154, which controls the rate of flow in accordance with selected inputs, such as deposition rate of droplets in a deposition chamber or a manual input of the desired flow rate. Alternately, the compressed gas may be provided to the chamber directly through a flow control orifice.

The droplets 146 are carried to an outlet 156 into a first impactor chamber provided in the housing, having an impactor plate 160. The impactor plate collects the larger droplets and droplets or aerosol particles below the cutoff point of the impactor are carried to an outlet 162 and into a second impactor chamber 164.

The second impactor chamber 164 has an impactor plate 166, which removes additional oversize droplets, and the resulting aerosol is then discharged out an outlet 168 to a deposition chamber for coating a wafer or substrate.

Figure 9:
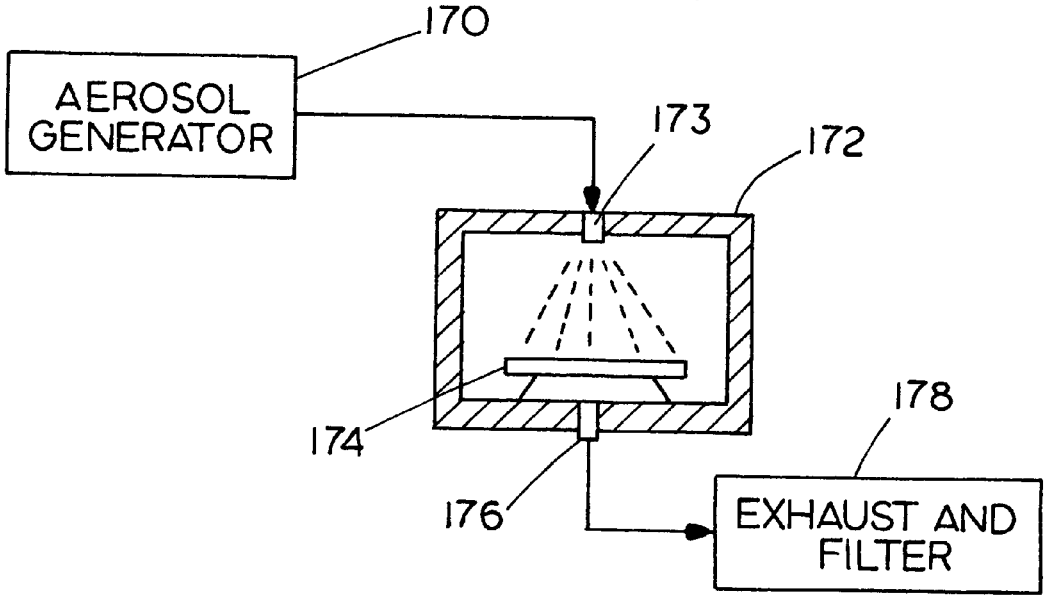
FIG. 9 is a schematic representation of a typical aerosol deposition chamber used with the improved aerosol generator of the present invention.
Figure 10:
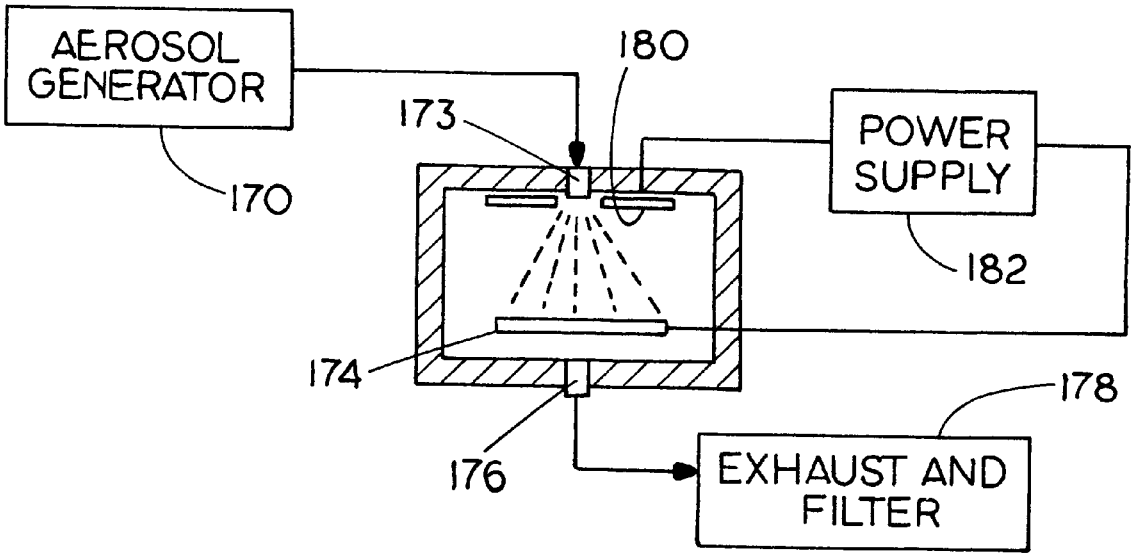
FIG. 10 is a modified version of the aerosol generator and deposition chamber of FIG. 9 using an additional electrode for enhancing particle deposition.

The various methods of aerosol generation described above can be used with a deposition chamber for depositing particles onto a surface without an applied electric field as shown in FIG. 9, or with an applied electric field as shown in FIG. 10. Schematically the aerosol generator 170 provides a flow of an aerosol to a deposition chamber 172, through an inlet 173 aligned with a wafer or substrate 174 positioned on a support. The flow of gas passes out an outlet 176 and then through a filter 178 for exhaust.

In FIG. 10 the same arrangement is shown and is numbered the same, except that an electrode 180 is positioned surrounding the inlet 173. A power supply 182 is connected between the wafer (it is connected to the wafer support) and the electrode 180 to create an electric field between the electrode and wafer to aid in moving the aerosol particles toward the wafer.

A flow of clean purge gas can be used in the chamber 172 to reduce contamination in the preferred method shown in U.S. Pat. No. 5,534,309 referred to above.

The methods and apparatus described above can be used for the controlled generation of a droplet aerosol. If the aerosol material to be deposited is in the form of a viscous liquid or a solid, the material must first be dissolved in a suitable solvent or suspended in a carrier liquid for atomization. Some of the solvent or carrier liquid will evaporate from the atomized droplets, while the remainder will stay with the droplets and deposit on a surface. When enough droplets are deposited on the surface a thin layer will form. The remaining solvent or carrier liquid can then be evaporated from the surface to form an even thinner layer of the non-volatile aerosol material.

The method and apparatus are particularly advantageous for the formation of an aerosol having particles of a photoresist material for deposition onto a semiconductor wafer in order to form a thin layer of photoresist for photolithography. In current technology, photoresist is applied to wafers by spinning. A measured amount of photoresist solution is applied to the center of a spinning wafer and flows out radially over the wafer surface by centrifugal force. Most of the liquid is spun out as droplets at the edge of the wafer and collected as waste. The thin layer of photoresist remaining on the wafer surface is used for subsequent photo-lithography. This conventional method of photoresist application is quite wasteful of material. Typically only a small fraction of the photoresist, from less than on percent to a few percent of the photoresist is deposited on the wafer and utilized while the rest is collected as waste.

The method and apparatus described in this invention, when used to form an aerosol carrying photoresist particles for deposition on wafers, can result in significant saving in photoresist material. Only a small amount of photoresist material is aerosolized in this invention, and most of the aerosolized materials are deposited on the wafer by the method and apparatus described with little or essentially no waste. The resulting photoresist layer can also be much thinner than can be achieved by the conventional spin-coating method. This is important for the new generation of semiconductor integrated circuit devices with very small line widths.

Another application of the methods and apparatus here described is the generation particles of a high dielectric constant material, such as barium strontium titante (BST), which is gaining increasing important to semiconductor device fabrication. Thin layers of liquid containing the required ingredients to make BST films deposited by the methods and apparatus here described would make it possible for the formation of thin films on the wafer for semiconductor device fabrication.

Although the present invention has been described with reference to preferred embodiments, workers skilled in the art will recognize that changes may be made in form and detail without departing from the spirit and scope of the invention.

What is claimed is:

1. A charged droplet atomizer comprising a source of a liquid containing a desired material for deposition on a surface with the liquid being reduced to aerosol droplets in a chamber, a source of compressed gas to atomize the liquid in an atomizer nozzle and forming a flow through the chamber to carry the aerosol droplets through an outlet, and an induction electrode positioned close to the atomizing nozzle and connected to a power source to induce an electrical charge on the droplets during atomization to produce a charged droplet aerosol containing the desired material for fabricating integrated circuit devices, and a separate deposition chamber connected to the outlet to receive previously charged droplets.

2. The atomizer of claim 1 wherein the apparatus includes an inertial separator for receiving a flow of gas and aerosol droplets after the flow of gas and aerosol droplets has moved past the induction electrode to remove larger aerosol droplets prior to their discharge from the atomizer.

3. The atomizer of claim 1 wherein there is an inertial separator for receiving the aerosol droplets and removing large aerosol droplets above a cutoff size after the charged aerosol droplets have formed and prior to their discharge from the atomizer.

4. The atomizer of claim 2 wherein the chamber has a supply of liquid therein and wherein an ultrasonic generator is mounted in the chamber to expose the liquid to ultrasonic energy to form aerosol droplets above the liquid.

5. The atomizer of claim 4 wherein there are two inertial separators in series through which the aerosol particles are carried by the flow of gas and aerosol droplets prior to discharge of the flow of gas and aerosol particles from the atomizer.

6. The atomizer of claim 1 wherein the apparatus for controlling the characteristics of the aerosol droplets further includes an inertial separator for receiving a flow of gas and aerosol droplets after the flow of gas has moved by the electrode, operable to remove larger aerosol droplets from the flow of gas prior to the discharge of the flow from the atomizer.

7. The atomizer of claim 1 wherein the electrode is a plate electrode against which the flow of gas and aerosol particles from the nozzle impinges.

8. The atomizer of claim 1 wherein the electrode is a ring electrode through which a majority of the flow of gas and aerosol particles from the nozzle passes.

9. The atomizer of claim 1 wherein the electrode is a screen forming an electrode through which a majority of the flow of gas and aerosol particles from the nozzle passes.

10. The atomizer of claim 1 wherein the desired material for deposition comprises a photoresist solution, and a wafer supported in the deposition chamber positioned to receive a thin layer of photoresist material carried by said aerosol.

11. The aerosol generator of claim 1 wherein a semiconductor wafer is supported in said deposition chamber, and wherein the material for deposition comprises an integrated circuit thin film material.

12. The atomizer of claim 1 wherein the desired material comprises a material used for integrated circuit devices, a wafer mounted in said deposition chamber and in position to have a surface receiving the aerosol from the outlet for deposition on a surface of the wafer.

13. The atomizer of claim 1 wherein the desired material for deposition is a photoresist.

14. The atomizer of claim 1 wherein the desired material for deposition comprises a thin film integrated circuit material.

15. An atomizer comprising a source of a liquid containing a desired material for deposition on a surface with the liquid being reduced to aerosol particles in a chamber, a source of compressed gas forming a flow through the chamber to carry the aerosol particles to an outlet, a liquid feed nozzle for spraying liquid into the chamber to reduce the liquid to aerosol particles carried in the gas, the outlet from the chamber comprising an outlet tube aligned with the liquid feed nozzle, an induction electrode comprising a ring electrode aligned with the liquid feed nozzle and the outlet tube to provide a charge to the aerosol particles received from the liquid feed nozzle prior to discharge of the flow of gas and aerosol particles from the outlet tube.

16. A method of forming an aerosol containing particles of a desired material to be deposited on a surface, comprising the steps of providing a liquid containing the desired material for deposition on a surface, reducing the liquid to aerosol form in an atomizer nozzle, and inducing an electrical charge on the aerosol particles by providing an electrode adjacent to the atomizer nozzle and under an electrical potential sufficient to cause charge induction, and introducing the charged particles into a separate deposition chamber.

17. The method of claim 16 including the step of inertially separating large particles from the aerosol prior to discharge from the atomizer outlet.

* * * * *